US008517335B2

(12) United States Patent
Tondolo et al.

(10) Patent No.: US 8,517,335 B2
(45) Date of Patent: Aug. 27, 2013

(54) FAIL-FREEZE DEVICE FOR POSITIONER

(75) Inventors: Flavio Tondolo, Stezzano (IT); Roberto Valoti, Seriate (IT)

(73) Assignee: STI Srl, Gorle-Bergamo (IT)

( * ) Notice: Subject to any disclaimer, the term of this patent is extended or adjusted under 35 U.S.C. 154(b) by 288 days.

(21) Appl. No.: 12/784,790

(22) Filed: May 21, 2010

(65) Prior Publication Data

US 2011/0284083 A1 Nov. 24, 2011

(51) Int. Cl.
*F16K 31/02* (2006.01)

(52) U.S. Cl.
USPC ..... 251/129.04; 60/404

(58) Field of Classification Search
USPC ..... 251/68, 69, 129.04, 129.05, 129.06; 91/461; 60/404
See application file for complete search history.

(56) References Cited

U.S. PATENT DOCUMENTS

| | | | | |
|---|---|---|---|---|
| 3,943,824 | A | 3/1976 | Fletcher | |
| 4,647,004 | A * | 3/1987 | Bihlmaier | 251/28 |
| 5,220,861 | A * | 6/1993 | Kamimura | 91/360 |
| 5,343,703 | A * | 9/1994 | Kamimura | 60/403 |
| 6,053,202 | A * | 4/2000 | Cunningham | 137/596.16 |
| 6,625,982 | B2 * | 9/2003 | Van Den Bossche et al. | 60/403 |
| 6,640,833 | B2 | 11/2003 | Brocard et al. | |
| 6,655,404 | B2 * | 12/2003 | Hilaire | 137/86 |
| 6,923,212 | B2 | 8/2005 | Tranovich et al. | |
| 7,650,905 | B2 * | 1/2010 | Kubota et al. | 137/554 |
| 2001/0035512 | A1 * | 11/2001 | Messer et al. | 251/129.04 |
| 2002/0007727 | A1 * | 1/2002 | Lafler et al. | 91/461 |
| 2010/0037957 | A1 | 2/2010 | Tabelander | |
| 2010/0212490 | A1 * | 8/2010 | Hahn et al. | 91/461 |

FOREIGN PATENT DOCUMENTS

| | | |
|---|---|---|
| DE | 102005004418 | 8/2006 |
| EP | 0822344 | 2/1998 |

OTHER PUBLICATIONS

"Elektropneumatischer Stellungsregler SIPART PS, Siemens Katalog MP31," Siemens Katalog MP31, XX, XX, Jan. 1, 1996.
Extended European Search Report for EP Application No. 11425167. 1. Nov. 18, 2011.
STI. "Instruction Manual FasTrak FT Smart Positioner." 48 pages. www.stiactuation.com. Aug. 2008.
Emerson Process Management. "Instruction Manual Supplement, Fieldview DVC6000 Series Digital Valve Controllers Instruction Manual." 6 pages. www.fisher.com. Feb. 2009.

* cited by examiner

*Primary Examiner* — John K Fristoe, Jr.
*Assistant Examiner* — Reinaldo Sanchez-Medina
(74) *Attorney, Agent, or Firm* — Stetina Brunda Garred & Brucker

(57) ABSTRACT

A fail-freeze valve positioner system is disclosed. The system has a transducer with a first type output port connectible to a valve actuator, and a second type input port receptive to a valve position signal that is proportional to an output of the first type output port. In addition, the system has a monitoring circuit that generates a pilot activation signal while predefined conditions are met. A primary piloted valve in communication with the monitoring circuit is coupled to the first valve. The first type output port is disconnected from the valve actuator while the pilot activation signal and thus the first valve are deactivated, holding the valve actuator in place.

22 Claims, 3 Drawing Sheets

FAIL-FREEZE DEVICE FOR POSITIONER

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Technical Field of the Invention

The present disclosure is related generally to fluid flow control and electro-hydraulic/electro-pneumatic systems, and more particularly, to a valve positioner including a fail-safe that maintains the position of the valve to that of a pre-failure state.

2. Description of the Related Art

A control valve regulates a flowing fluid, such as gas, steam, water, or chemical compounds by opening and closing a passageway, through which the fluid flows, with a valve element. The subject flowing fluid is generally referred to as the process. An actuator, in turn, provides the motive force to open and close the valve element. Pneumatic or hydraulic energy is converted by the actuator to rotational or linear motion, depending on the configuration of the valve element.

Typically, pneumatic systems are utilized for valve actuators due to several distinct advantages. For instance, air, rather than fluids such as oil, is exhausted into the atmosphere, and compressed air is better able to absorb excess pressure and pressure spikes. There are other peripheral advantages such as fewer maintenance requirements.

A conventional pneumatic actuator is comprised of a piston sealed within a cylinder, and the piston including a connecting rod that is mechanically coupled to the valve element. Compressed air is forced into and out of the cylinder to move the connecting rod. In a single-acting actuator, the compressed air is taken in and exhausted from one end of the cylinder and is opposed by a range spring, while in a double-acting actuator, air is taken in one end of the cylinder while simultaneously exhausting it out of the opposing end.

Precise and accurate control of the valve actuator, and hence the valve element, can be achieved with a positioner device coupled thereto. Pneumatic valve positioners, which can cooperate with aforementioned pneumatic actuators, are well known in the art. The proportional movement of the actuator is accomplished by the movement of compressed air into and out of the actuator piston, as indicated above. More particularly, valve positioners incorporate a spool (or other devices) that either rotates or slides axially in a housing the port the flow of compressed air to the actuator or to one or more exhaust ports.

In further detail, an electrical control circuit provides a variable current signal to the positioner device that proportionally corresponds to particular states of the actuator and hence a particular position of the control valve. The electrical control circuit and the electrical current signals generated thereby may be part of a broader process managed by a distributed control system (DCS). Generally, the electrical current varies between 4 milliamps (mA) and 20 mA according to industry-wide standards; at 4 mA the valve positioner may fully open the valve element, while at 20 mA the valve positioner may fully close the valve element. The positioner compares the received electrical signal to the current position of the actuator, and if there is a difference, the actuator is moved accordingly until the correct position is reached.

There are a number of operational conditions or exceptions under which it becomes necessary to "freeze" in place the last position of the actuator. These include the complete loss of power to the positioner or other such failure therein, failure in the distributed control system, a wire carrying the actuator signal being cut, and so forth.

Various solutions for such "fail freeze" functions have been developed, though each one is deficient in one or more regards. One involves the use of an external component to monitor the electrical current signal, and driving a solenoid valve upon detection of a failure condition. This tends to be an expensive proposition, however, since a safe external power source is required, along with specialized components that monitors the electrical current such as a current threshold switch and controls the power to the solenoid. Additionally, a further wiring and junction box will be required. Overall, the increased complexity of this solution makes it particularly unsuitable (e.g., too expensive) for hazardous environments. Another solution involves the use of a positioner with normally closed on/off valves. This is also inadequate because the flow capacity of such positioners is typically so low that boosters are necessary to meet the specified stroking time. Furthermore, any leakage from the boosters essentially nullifies the freezing action. Yet another solution involves a pneumatic positioner with a separate fail-freeze electro-pneumatic I/P converter. Again, this solution has proven deficient, as the separate positioner has a slow response time of around six (6) seconds, such that stroking the actuator within the required limits is not possible.

Accordingly, there is a need in the art for an improved valve positioner with a failsafe that maintains the position of the valve to that of a pre-failure state. Moreover, this is a need in the art for a valve positioner that includes a fail-freeze function powered from the electrical current signal loop thereto without an external source. There is also a need for valve positioners with a fail-freeze function that are intrinsically safe.

BRIEF SUMMARY OF THE INVENTION

In accordance with one embodiment of the present disclosure, a valve positioner system is contemplated. The system may have a transducer with a first type output port connectible to a valve actuator, as well as a second type input port receptive to a valve position signal. The valve position signal may be proportional to an output of the first type output port. Additionally, the system may include a monitoring circuit. A pilot activation signal may being generated thereby while predefined conditions are met. There may also be a primary piloted valve in communication with the monitoring circuit. The primary piloted valve may have a first position in absence of the pilot activation signal, and a second position during receipt of the pilot activation signal. The valve positioner system may include a first valve coupled to the primary piloted valve. The first valve may have a first position corresponding to the first position of the primary piloted valve, and a second position corresponding to the second position of the primary piloted valve. The first type output port may be disconnected from the valve actuator while the first valve is in the first position, while the first type output port may be in fluid communication with the valve actuator while the first valve is in the second position.

In accordance with another embodiment of the present disclosure, a valve positioner failsafe device is contemplated. The device may include an electro-pneumatic transducer with transducer output ports and an electrical input port receptive to a valve position signal. A pressure value of the transducer output may be proportional to an electrical current level value of the valve position signal. The device may also include an electrical current level monitoring circuit receptive to the valve position signal. A pilot activation signal may generated while the current value of the valve position signal remains greater than a predetermined failure value. There may also be a primary piloted valve including a primary piloted valve output port and a pressure line intake port. The primary piloted valve may be in communication with the current level monitoring circuit. Furthermore, there may be a first valve including a first valve pilot input port connected to the primary piloted valve output port. A first valve input port may be coupled to a first one of the transducer output ports, and a first valve output port may be coupled to a first one of actuator input ports of a valve actuator. The first valve may selectively fluidly couple the transducer to the actuator.

According to yet another embodiment of the present disclosure, a method for fail-safe regulation of a process with a valve positioner including an actuator is contemplated. The method may begin with receiving a valve position signal. Thereafter, the method may include deactivating a pilot signal to a pneumatic piloted valve. This may be in response to the valve position signal having a current value less than a predetermined failure level. The method may also include switching closed the pneumatic piloted valve in response to deactivating the pilot signal. Additionally, the method may include switching closed a first valve selectively coupling a first output of the valve positioner to a first input of the actuator. This may be in response to the switched closed pneumatic piloted valve. Pneumatic pressure to the first input of the actuator existing prior to the deactivation of the pilot signal may be maintained upon the closing of the first valve.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION OF THE INVENTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
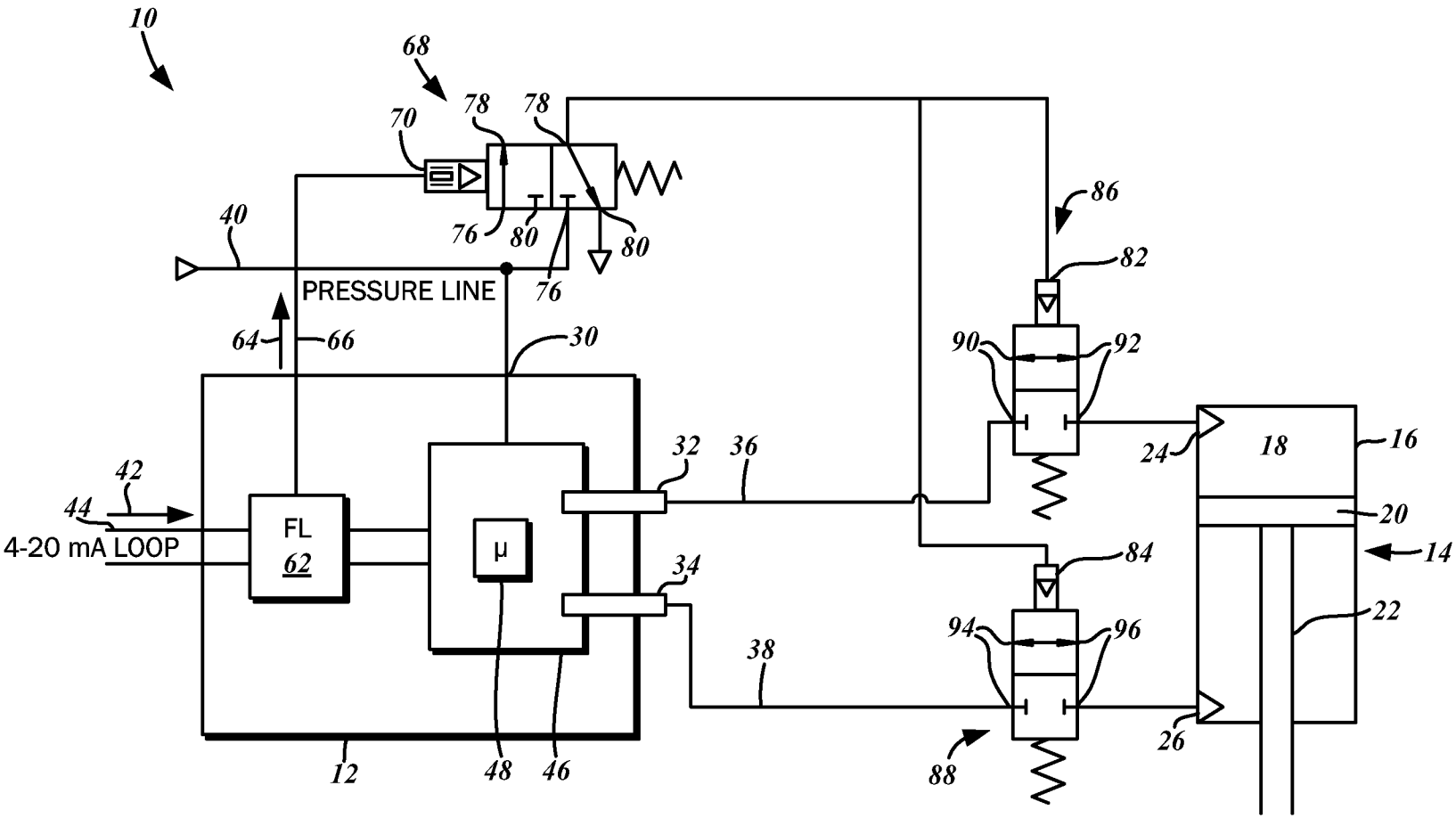
FIG. 1 is a block diagram illustrating the various components of a failsafe system for a valve positioner according to one embodiment of the present invention.

The block diagram of FIG. 1 illustrates a valve positioner failsafe system 10 in accordance with one embodiment of the present disclosure. Generally, there is a positioner device 12 coupled to a valve actuator 14 that modifies the position of a control valve (not shown) in regulating a part of a fluid flow process. As previously noted, the valve actuator 14 includes a cylinder body 16 defining a chamber 18. A piston 20 reciprocates within the cylinder body 16 as compressed air is supplied and exhausted therefrom. The piston 20 is mechanically coupled to a connecting rod 22, which in turn is coupled to the control valve. The particular configuration of the linear valve actuator 14 is presented by way of example only, and any other type of actuator, such as a rotary type or a diaphragm type may be substituted.

The components of the valve positioner failsafe system 10 are variously described herein as being driven by compressed air, though it will be appreciated that any other inert gasses may be utilized. Along these lines, other fluid power systems such as hydraulics may be substituted without departing from the scope of the present disclosure. As indicated above, however, compressed air offers several advantages with respect to response times and safety in potentially hazardous industrial environments.

The illustrative example shows a first fluid flow passageway 24 and a second fluid flow passageway 26 defined by the cylinder body 16, which is characteristic of a double-acting actuator in which compressed air is supplied to one side of the chamber 18 while the other side is exhausted. It is expressly contemplated, however, that a single-acting actuator with spring return may be used instead, along with attendant modifications to the configuration of the positioner device 12.

Figure 2:
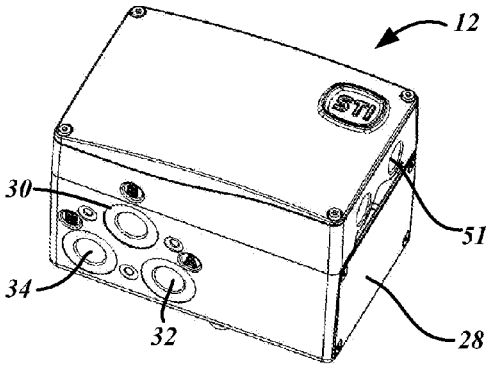
FIG. 2 is a perspective view of an exemplary valve positioner device.

The supplying and exhausting of the compressed air to the valve actuator 14 is governed by the positioner device 12, an exemplary variation of which is illustrated in FIG. 2. The positioner device 12 may also be referenced as valve position controller or a servomechanism, and its components enclosed within a housing 28. The positioner device 12 includes a pressure line intake port 30, a first output port 32, and a second output port 34, each of which define openings on the housing 28 receptive to connecting hoses. In particular, the first output port 32 is in fluid communication with the first fluid flow passageway 24 of the valve actuator 14 over a first pneumatic connecting line 36, and the second output port 34 is in fluid communication the second fluid flow passageway 26 of the valve actuator 14 over a second pneumatic connecting line 38. The first and second output ports 32, 34 may also referenced as first type output ports, that is, pneumatic type output ports, as distinguished from electrical or hydraulic type output ports. The pressure line intake port 30 receives compressed air from a pressure line 40 coupled to a remote source.

With reference again to the block diagram of FIG. 1, the basic function of the positioner device 12 involves the selective porting of compressed air from the pressure line 40 to the first fluid passageway 24 and the second fluid flow passageway 26 of the valve actuator 14 to provide a motive force thereto such that the position of the control valve can be adjusted. The volume of compressed air flowing to the valve actuator 14 depends upon an external input, which according to one embodiment, is a valve position signal 42 provided to the positioner device 12 over a two-wire connection 44. Input ports receptive to the two-wire connection 44 are also referred to as a second type input port, that is, an electrical input port, distinguished from a first type (pneumatic) port. The two-wire connection 44 is linked to a central regulator station that transmits the valve position signal 42 to the positioner device 12. It is understood that there may be other positioner devices 12 connected to the central regulator station, in which other related or unrelated processes and control valves therefor are managed.

Per common industry standards, the valve position signal 42 is an analog current ranging between 4 mA and 20 mA. Although the basic operation of the valve positioner failsafe system 10 does not require it, the valve position signal 42 can carry a digital signal utilized by positioner device 12 for additional functionality such as diagnostics, configuration, and so forth, and is accordingly HART compliant (Highway Addressable Remote Transducer). As will be described in further detail below, the valve position signal 42 also provides electrical power to the positioner device 12 and other associated components.

The valve position signal 42 can be quantified as a percentage of the fully open or fully closed position of the control valve, and more specifically, as the pressure of the compressed air that is ported from the pressure line intake port 30 to the first and second output ports 30, 32 for achieving that position. For example, upon proper calibration, a 0% (4 mA) input signal may be defined as the fully closed position, while a 100% signal (20 mA) input signal may be defined as the fully open position. A 12 mA signal may thus represent a 50% position.

An electro-pneumatic transducer 46, and specifically a microprocessor 48 therein, receives the valve position signal 42. In order to ensure correct positioning of the valve actuator 14, a feedback sensor reads the actual position of the valve actuator and transmits a signal representative thereof to the microprocessor 48. The valve position signal 42 includes a set point or reference value, to which the value of the actual position signal is compared. The transducer 46 is then adjusted to supply more or less compressed air to the valve actuator 14 to position the same to the designated set point. A variety of different algorithms may be used to effect a change in the flow rate of compressed air to the valve actuator 14.

Figure 3:
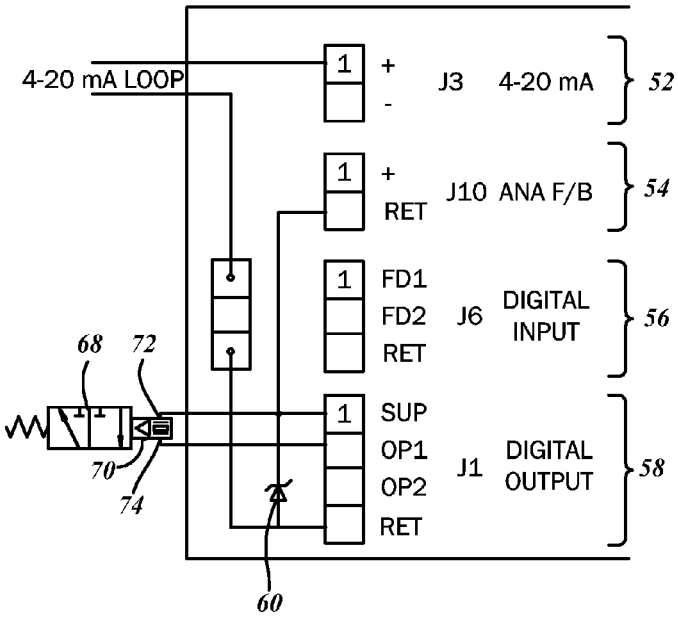
FIG. 3 is a wiring diagram illustrating the various electrical connections of the valve positioner device.

FIG. 3 best illustrates the various electrical connections to the positioner device 12 included in a terminal block 50. There are several terminal groups, each having a specific function. A valve position terminal group 52 includes a set point line and a return (negative) line that is connected to ground. An analog feedback terminal group 54 includes an input line connected to the aforementioned valve position feedback sensor. There is also a digital input terminal group 56 including a plurality of input lines, as well as a digital output terminal group 58 including a voltage supply line (SUP) and a plurality of output lines (OP1, OP2), the uses for which will be described in greater detail below. The return line (RET) of the digital output terminal group 58 is also tied to the return line of the valve position terminal group 52. With reference to FIG. 2, the housing 28 also defines electrical adapter ports 52, through which the various connectors for the two-wire connection 44 are routed.

The positioner device 12 is understood to be suitable for hazardous environments where flammable gasses in the environment have the potential to ignite from sparks typical in regular circuits and constituent components thereof. In this regard, the positioner device 12 is understood to be intrinsically safe, in that, among other things, the electrical components and any others devices utilized therein operate on low voltages.

In accordance with one embodiment of the present disclosure, valve positioner failsafe system 10 is contemplated to include a "fail-freeze" function. As described above, "fail-freeze" refers to a function where the position of the actuator device 14 is held to that most recent prior to failure. These failures include loss of power due to the two-wire connection 44 being disconnected from the signal source, a loss of pressure in the pressure line 40, loss of the actuator position feedback signal, and so forth. The present disclosure includes a description of one embodiment where the loss of electrical power triggers the fail-freeze function, and is presented by way of example only and not of limitation. Other failure conditions such as those enumerated above may also trigger the fail-freeze function, and it is understood that other embodiments of the valve positioner failsafe system 10 may be adapted thereto.

Referring to FIG. 1, the positioner device 12 includes a monitoring circuit 62. Although depicted as being a part of the positioner device 12, it is expressly contemplated that the monitoring circuit 62 can be an independent device. The monitoring circuit 62 is placed in series with the two-wire connection 44 to the pneumatic transducer 46, and accordingly, is receptive to the incoming valve position signal 42. As indicated above, the valve position signal 42 powers the monitoring circuit 62 by virtue of powering the positioner device 12. The current supplied to the pneumatic transducer 46 is understood to be in the same 4-20 mA range discussed previously. Presently, without the monitoring circuit 62, input voltage to the pneumatic transducer 46 is understood to be within the range of 12 to 30 volts. With the series addition of the monitoring circuit 62, the input voltage range may increase to 20 to 30 volts.

The monitoring circuit 62 in accordance with one embodiment of the present disclosure continuously evaluates the electrical current level of the valve position signal 42. So long as the electrical current level remains above a predefined failure level, a pilot activation signal 64 is generated on a monitor output line 66. By way of example only and not of limitation, this predefined failure level may be 3.7 mA in where a proper signal has a range between 4 mA and 20 mA. As noted above, other failure conditions besides a loss of the valve position signal 42 can be monitored. In this regard, the pilot activation signal 64 can also remain on while such other failure conditions are not detected. Therefore, appropriate threshold values of monitored conditions such as system-wide compressed air pressure, position feedback error rate, and so forth, can be preset.

The valve positioner failsafe system 10 also includes a primary piloted valve 68 that is in communication with the monitoring circuit 62. With further reference to FIG. 3, the primary piloted valve 68 includes a piezoelectric (or any other low power) pilot element 70 with a positive line 72 and a negative line 74. The positive line 72 is in turn connected to the voltage supply line (SUP) of the digital output terminal group 58, as well as the return (negative) line of the valve position terminal group 52. Hence, the piezoelectric pilot element 70 is placed in series with the two-wire connection 44 and is also powered thereby.

With the power supplied to the microprocessor 48, which is also in series with the two wire connection 44 (parallel with the piezoelectric pilot element 70), a low or an open value is output to the digital output line (OP1) on the digital output terminal group 58 as the pilot activation signal 64. By outputting a low value, electrical current flows through the piezoelectric pilot element 70, thereby activating the primary piloted valve 68. Thus, during normal operation, the pilot activation signal 64 and hence the primary piloted valve 68 remains on. However, by outputting an open value, to the extent there is any electrical power remaining on the positive line 72 after a failure is detected, the piezoelectric pilot element 70 is powered off and the primary piloted valve 68 is deactivated.

The primary piloted valve 68 is understood to be a conventional normally closed three/two way valve with spring return. Power consumption is understood to be approximately 6 millwatts (mW), and while having a very low fluid flow rate (CV), further work may be performed with its output. Such low power devices are also known to be intrinsically safe and suitable for use in hazardous environments.

Figure 4:
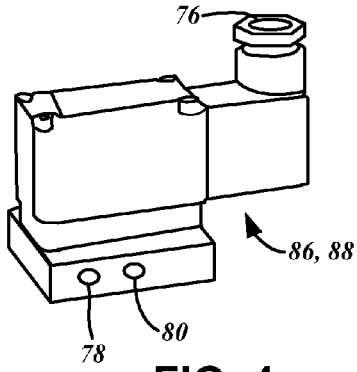
FIG. 4 is a perspective view of an exemplary piezo-electric piloted valve.

As best illustrated in FIG. 4, the primary piloted valve 68 has a pressure line intake port 76 coupled to the pressure line 40, a primary output port 78, and a secondary output port 80. In its normally closed or deactivated first position, the pressure line intake port 76 is not in fluid communication with neither the primary output port 78 nor the secondary output port 80. Instead, the primary output port 78 is in fluid communication with the secondary output port 80 that is being exhausted. In the activated, second position of the primary piloted valve 68, the pressure line intake port 76 is in fluid communication with the primary output port 78. Thus, compressed air from the pressure line 40 flows through and other work is performed therewith.

The primary output port 78 is in fluid communication with a first pneumatic pilot 82 of a first valve 86, as well as a second pneumatic pilot 84 of a second valve 88. The first and second valves are understood to be normally closed two-position valves with spring return that are interposed between the positioner device 12 and the valve actuator 14. More particularly, the first valve 84 has a first input port 90 in direct fluid communication with the first output port 32 of the positioner device 12 over the first pneumatic connecting line 36, and a first output port 92 in direct fluid communication with the first fluid flow passageway 24 of the valve actuator 14. Along these lines, the second valve 88 has a second input port 94 in direct fluid communication with the second output port 34 of the positioner device 12 over the second pneumatic connecting line 38, and a second output port 96 in direct fluid communication with the second fluid flow passageway 26 of the valve actuator 14.

Without the compressed air flowing from the primary output port 78 of the primary piloted valve 68, the first valve 84 and the second valve 88 remain in a first closed position in which the first input port 90 and the second input port 94 are obstructed from the first output port 92 and the second output port 96, respectively. Once the first pneumatic pilot 82 is activated by a flow of compressed air from the primary output port 78 of the primary piloted valve 68, the first valve 84 and the second valve 88 are turned on, thereby connecting the first input port 90 and the second input port 94 to the first output port 92 and the second output port 96, respectively. When the first valve 84 and the second valve 88 are deactivated, the pressure at the first fluid flow passageway 24 and the second fluid flow passageway 26, respectively, are maintained at levels immediately prior to such first and second valves 84, 88 being triggered off.

Figure 5:
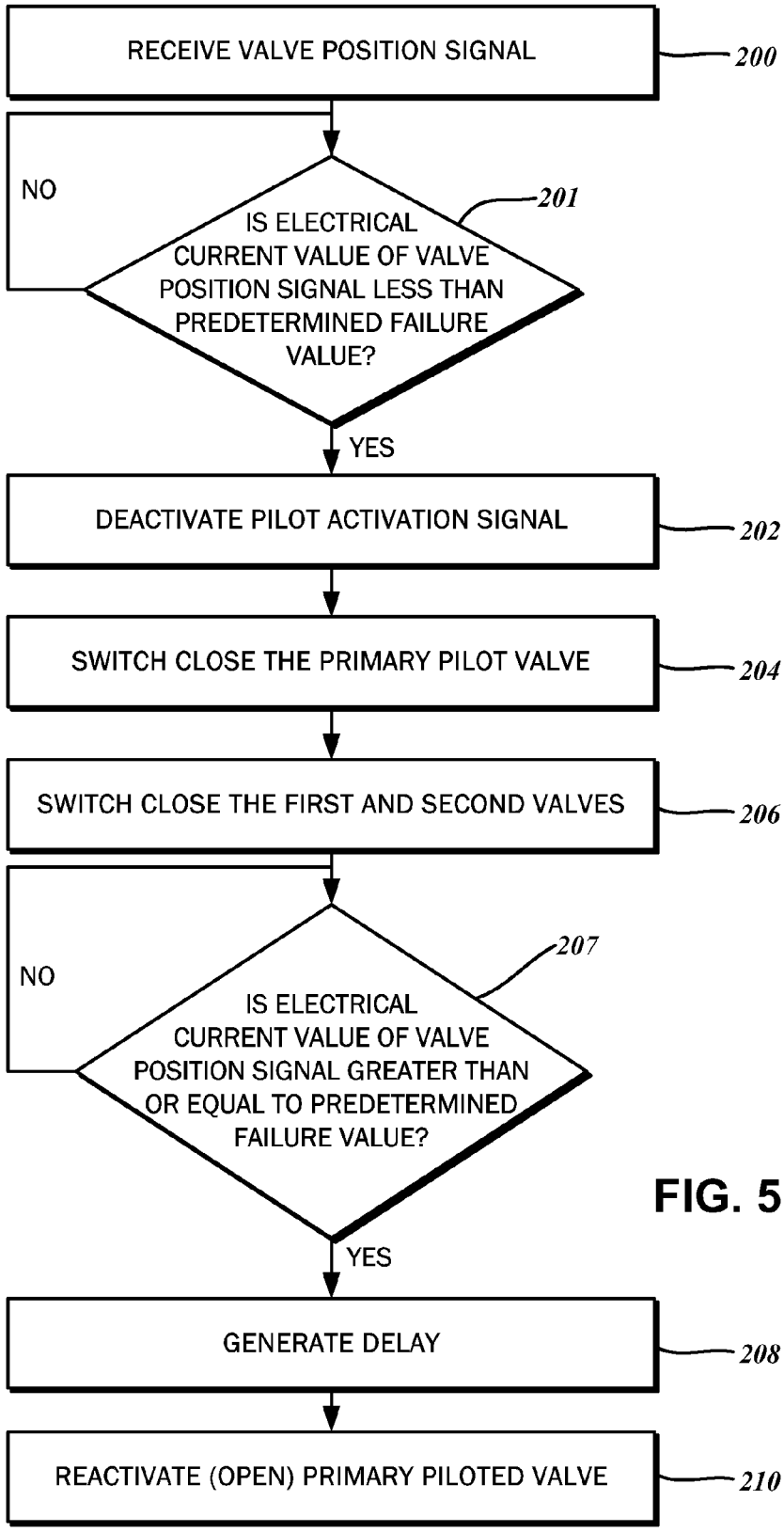
FIG. 5 is a flowchart showing the steps of a method for fail-safe regulation of a process with the valve positioner according to another embodiment of the present invention.

With reference to the flowchart of FIG. 5, a method for fail-safe regulation of a process with the positioner device 12 and the valve actuator 14 is contemplated in accordance with another embodiment of the present disclosure. The method begins with a step 200 of receiving the valve position signal 42 over the two-wire connection 44. The method then continues with a step 202 of deactivating the pilot activation signal 64 that is being transmitted to the primary piloted valve 68. This is understood to occur in response to the valve position signal 42 having an electrical current value less than a predetermined failure level or threshold, as noted above and evaluated in decision step 201.

Once the pilot activation signal 64 is turned off, the method continues with a step 204 of switching closed the primary piloted valve 68. Turning off the flow of compressed air through the primary piloted valve 68 also deactivates the first pneumatic pilot 82 and the second pneumatic pilot 86. Thereafter, according to step 206, the first valve 84 and the second valve 88 are switched closed. This, in turn, has the effect of cutting off the flow of compressed air from the positioner device 12 to the valve actuator 14, and holding the pressure to the valve actuator 14 from just before the deactivation of the pilot activation signal 64.

As long as the valve position signal 42 has an electrical current value less than the predetermined failure level or threshold, the state of the valve positioner failsafe system 10 as of step 206 is maintained, that is, the valve actuator is kept in a "fail freeze" position. After evaluation step 207 is found true, in which the electrical current value is greater than or equal to the predetermined failure level or threshold, the method continues with a step 208 of generating a delay. This delay is understood to correspond to the delay in restarting the positioner device 12. Then, according to step 210, the primary piloted valve 68 is reactivated. This, in turn, activates the first pneumatic pilot 82 and the second pneumatic pilot 86, switching the first valve 84 and the second valve 88, respectively, to the opened second position. The flow of compressed air from the positioner device 12 to the valve actuator 14 therefore resumes.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A valve positioner system comprising:

a transducer including a first type output port connectible to a valve actuator and a second type input port receptive to a valve position signal of a second type input, the transducer generates on the first type output port at a given instant a quantified value of a first type output that is proportional to the valve position signal, a variable position of the valve actuator over a predetermined positional range being directly set in correspondence with the quantified value of the first type output at the given instant;

a monitoring circuit, a pilot activation signal being generated thereby while predefined conditions are met;

a primary piloted valve in communication with the monitoring circuit, the primary piloted valve having a first position in absence of the pilot activation signal; and a first valve coupled to the primary piloted valve, the first valve having a first position correspondingly linked in a dependent relationship to the first position of the primary piloted valve;

wherein the first type output port of the transducer is disconnected from the valve actuator with the valve actuator being maintained in a static position based upon an obstruction of the first valve in the first position.

2. The system of claim 1, wherein:

the primary piloted valve has a second position during receipt of the pilot activation signal;

the first valve has a second position correspondingly linked in a dependent relationship to the second position of the primary piloted valve; and the first type output port is in fluid communication with the valve actuator while the first valve is in the second position.

3. The system of claim 1, wherein:

the first type output port is pneumatic;

the transducer includes a first type input port connected to a pressure line; and the second type input port is electrical.

4. The system of claim 3, wherein a pressure value of the first type output through the first type output port is automatically controlled by a positioner which is operative to compare an electrical current value of the valve position signal to an existing position of the valve actuator, and to potentially move the valve actuator to a corrected position as a result of such comparison.

5. The system of claim 4, wherein:

the monitoring circuit is receptive to the valve position signal;

the predefined condition is the electrical current value of the valve position signal remaining greater than a predetermined failure value.

6. The system of claim 5, wherein the valve position signal has a nominal current value between 4 and 20 milliamperes (mA).

7. The system of claim 3, wherein:

the monitoring circuit derives a system pressure value from the pressure line; and the predefined condition is the system pressure value remaining greater than a predetermined failure value.

8. The system of claim 3, wherein the predefined condition is an actuator position feedback indicator remaining within a predetermined failure threshold value.

9. The system of claim 3, wherein power for the pilot activation signal is derived from the valve position signal.

10. The system of claim 3, wherein the first valve is a normally closed, spring actuated pneumatic valve.

11. The system of claim 3, wherein the primary piloted valve includes a low power pilot valve energized with the pilot activation signal.

12. The system of claim 1, further comprising:

a second valve coupled to the primary piloted valve, the second valve having first position corresponding to the first position of the primary piloted valve, the first type output port being disconnected from the valve actuator while the second valve is in the first position.

13. A valve positioner failsafe device comprising:

an electro-pneumatic transducer including transducer output ports and an electrical input port receptive to a valve position signal, an instantaneous pressure value of the transducer proportional to an instantaneous electrical current level value of the valve position signal being output to directly set the variable position of the valve actuator over a predetermined position range in correspondence with the instantaneous pressure value;

a current level monitoring circuit receptive to the valve position signal, a pilot activation signal being generated while the electrical current value of the valve position signal remains greater than a predetermined failure value;

a primary electrically piloted valve including a primary electrically piloted valve pneumatic output port and a pneumatic pressure line intake port, the primary electrically piloted valve being in communication with the electrical current level monitoring circuit; and a first valve including a first valve pneumatic pilot input port connected to the primary electrically piloted valve pneumatic output port linking the first valve to the primary electrically piloted valve in a dependent relationship, a first valve input port coupled to a first one of the transducer output ports, and a first valve output port coupled to a first one of actuator input ports of a valve actuator, the first valve selectively fluidly coupling the transducer to the actuator.

14. The device of claim 13, wherein power for the pilot activation signal is derived from the valve position signal.

15. The device of claim 13, wherein the valve position signal has a nominal current value between 4 and 20 milliamperes (mA).

16. The device of claim 13, further comprising:

a second valve including a second valve pneumatic pilot input port connected to the primary electrically piloted valve pneumatic output port linking the second valve to the primary electrically piloted valve in a dependent relationship, a second valve input port coupled to a second one of the transducer output ports, and a second valve output port coupled to a second one of the actuator input ports of the valve actuator.

17. An apparatus for fail-safe regulation of a process with a valve positioner operating on an actuator, the apparatus comprising:

a pneumatic piloted valve pneumatically coupled to the actuator and having an opened and closed position;

a first valve selectively coupling a first output of the valve positioner to a first input of the actuator, the first valve having an opened and closed position correspondingly linked in a dependent relationship to the opened and closed position of the pneumatic piloted valve;

a controller receptive to a valve position signal and connected to the pneumatic piloted valve, a pilot signal to the pneumatic piloted valve from the controller being deactivated in response to the valve position signal having an electrical measurement value less than a predetermined failure level;

wherein the pneumatic piloted valve is switched to a closed position with the pilot signal being deactivated and pneumatic pressure to the first input of the actuator existing prior to the deactivation of the pilot signal being maintained upon the first valve being switched to the closed position in correspondence with the pneumatic piloted valve being switched to the closed position;

wherein the first output of the valve positioner generates an instantaneous pneumatic value proportional to the valve position signal that directly sets a variable position of the valve actuator over a predetermined position range in correspondence with the instantaneous pressure value.

18. The apparatus of claim 17, further comprising:

a second valve selectively coupling a second output of the valve positioner to a second input of the actuator, the second valve having an opened and closed position correspondingly linked in a dependent relationship to the opened and closed position of the pneumatic piloted valve;

wherein pneumatic pressure to the second input of the actuator existing prior to the deactivation of the pilot signal is maintained with the second valve being switched to the closed position.

19. The apparatus of claim 17, wherein the controller is adapted to detect the electrical measurement value of the valve position signal being greater than or equal to the predetermined failure level following a detection of the valve position signal having an electrical measurement value less than the predetermined failure level, and to reactivate the pneumatic piloted valve after a delay.

20. The apparatus of claim 17, wherein the first valve is normally closed.

21. The apparatus of claim 17, wherein the valve position signal has a nominal electrical measurement value between 4 and 20 milliamperes (mA).

22. The apparatus of claim 17, wherein power to the pneumatic piloted valve is derived from the received valve position signal.

* * * * *